US007770385B2

(12) United States Patent
Birkby

(10) Patent No.: US 7,770,385 B2
(45) Date of Patent: Aug. 10, 2010

(54) INTERNAL COMBUSTION ENGINE EXHAUST SYSTEM

(75) Inventor: Nicholas John Birkby, Preston (GB)

(73) Assignee: EMCON Technologies LLC, Wilmington, DE (US)

( * ) Notice: Subject to any disclaimer, the term of this patent is extended or adjusted under 35 U.S.C. 154(b) by 0 days.

(21) Appl. No.: 10/980,681

(22) Filed: Nov. 3, 2004

(65) Prior Publication Data

US 2005/0109015 A1 May 26, 2005

(30) Foreign Application Priority Data

Nov. 25, 2003 (GB) ..... 0327332.4

(51) Int. Cl.
*F01N 3/00* (2006.01)

(52) U.S. Cl. ..... 60/295; 60/274; 60/278; 60/286; 60/297; 60/303

(58) Field of Classification Search ..... 60/274, 60/278, 286, 292, 295, 297, 298, 300, 303, 60/311, 320, 321; 123/568.11, 568.12, 568.18
See application file for complete search history.

(56) References Cited

U.S. PATENT DOCUMENTS 4,270,936 A 6/1981 Mann
4,276,066 A 6/1981 Bly et al.
4,281,512 A 8/1981 Mills
4,319,896 A 3/1982 Sweeney
4,335,574 A 6/1982 Sato et al.
4,373,330 A 2/1983 Stark
4,381,643 A 5/1983 Stark
4,462,379 A * 7/1984 Tsuge et al. ..... 60/278
4,481,767 A 11/1984 Stark
4,520,624 A 6/1985 Kiyota et al.
4,535,588 A * 8/1985 Sato et al. ..... 60/286
4,573,317 A 3/1986 Ludecke
4,608,640 A * 8/1986 Shinzawa et al. ..... 701/101
4,622,810 A 11/1986 Shinsei et al.
4,651,524 A 3/1987 Brighton
4,677,823 A 7/1987 Hardy
4,730,455 A 3/1988 Pischinger et al.
4,840,028 A 6/1989 Kusuda et al.
4,848,083 A 7/1989 Goerlich
4,851,015 A 7/1989 Wagner et al.
4,969,328 A 11/1990 Kammel
5,024,054 A 6/1991 Barris et al.
5,048,287 A 9/1991 Howe et al.
5,063,737 A 11/1991 Lopez-Crevillen et al.
5,065,574 A 11/1991 Bailey
5,094,075 A 3/1992 Berendes
5,097,665 A 3/1992 Kammel
5,121,601 A 6/1992 Kammel (Continued)

FOREIGN PATENT DOCUMENTS

GB 2 134 407 A 2/1984

(Continued)

*Primary Examiner*—Binh Q. Tran
(74) *Attorney, Agent, or Firm*—Pamela A. Kachur

(57) ABSTRACT

An internal combustion engine exhaust system 10 comprises an exhaust gas recirculation pipe 22 which, in use, recirculates engine exhaust gas into the engine air intake. A particulate filter 18 is provided and a burner arrangement 36 is arranged to burn off particulates caught by the filter.

39 Claims, 2 Drawing Sheets

U.S. PATENT DOCUMENTS 5,140,814 A 8/1992 Kreutmair et al.
5,211,009 A 5/1993 Houben et al.
5,251,564 A 10/1993 Rim et al.
5,365,733 A 11/1994 Takeshima et al.
5,419,121 A 5/1995 Sung et al.
5,426,936 A * 6/1995 Levendis et al. ..... 60/278
5,558,760 A 9/1996 Sekhar
5,656,048 A 8/1997 Smith et al.
5,709,722 A 1/1998 Nagai et al.
5,711,149 A * 1/1998 Araki ..... 60/278
5,934,069 A 8/1999 Hertl et al.
5,946,906 A 9/1999 Akazaki et al.
6,003,303 A 12/1999 Peter-Hoblyn et al.
6,012,284 A 1/2000 Tanaka et al.
6,023,928 A 2/2000 Peter-Hoblyn et al.
6,063,150 A 5/2000 Peter et al.
6,182,445 B1 2/2001 Yamazaki et al.
6,233,926 B1 5/2001 Bailey et al.
6,276,130 B1 * 8/2001 Ito et al. ..... 60/278
6,321,533 B1 11/2001 Watanabe et al.
6,327,852 B1 12/2001 Hirose
6,338,245 B1 * 1/2002 Shimoda et al. ..... 60/285
6,344,306 B1 2/2002 Fujiyoshi et al.
6,422,006 B2 7/2002 Ohmori et al.
6,479,023 B1 11/2002 Evans et al.
6,560,958 B1 5/2003 Bromberg et al.
6,625,978 B1 * 9/2003 Eriksson et al. ..... 60/311
6,651,432 B1 * 11/2003 Gray, Jr. ..... 60/605.2
6,694,727 B1 2/2004 Crawley et al.
6,718,753 B2 4/2004 Bromberg et al.
6,981,370 B2 * 1/2006 Opris et al. ..... 60/311
7,007,459 B2 * 3/2006 Lee ..... 60/281
7,043,914 B2 * 5/2006 Ishikawa ..... 60/605.2
2002/0194835 A1 12/2002 Bromberg et al.
2003/0140622 A1 7/2003 Taylor, III et al.
2003/0200742 A1 10/2003 Smaling
2004/0020188 A1 2/2004 Kramer et al.
2004/0020191 A1 2/2004 Kramer
2004/0020447 A1 2/2004 Taylor, III et al.
2004/0050035 A1 3/2004 Smaling

FOREIGN PATENT DOCUMENTS

JP 356012045 A * 2/1981 ..... 60/295
JP 358074818 A * 5/1983 ..... 60/278
JP 358220915 A * 12/1983 ..... 60/278
JP 359020511 A * 2/1984 ..... 60/86
JP 363009619 A * 1/1988 ..... 60/295
JP 406066208 A * 3/1994 ..... 60/278
JP 02005016390 A * 1/2005 ..... 60/278

* cited by examiner

INTERNAL COMBUSTION ENGINE EXHAUST SYSTEM

This application claims priority under 35 U. S. C. §119 to United Kingdom Patent Application No. UK0327322.4 filed in the United Kingdom on Nov. 25, 2003.

FIELD OF THE DISCLOSURE

The invention relates to an internal combustion engine exhaust system and particularly but not exclusively limited to an exhaust system for a diesel engine.

BACKGROUND OF THE DISCLOSURE

Due to increasingly stringent emissions regulations, engine manufacturers are faced with a requirement to reduce all forms of emissions. Particulate emissions from diesel engines are substantially higher than petrol engines and one way to reduce the level of particulate emitted, diesel engine exhaust systems may include a particulate filter trap which catches a proportion of the particulate emitted by the engine. Over time, the filter becomes clogged with the filtered particulates and it is necessary to regenerate the filter in order to prevent excessive back pressure building up in the exhaust system which can reduce the engine's power output and eventually lead to engine failure. One known method of regenerating the particulate filter is to use the NOx generated in the engine to regenerate the particulate filter. In those systems, either the filter substrate has a catalytic coating or a separate catalyst is installed so that passing $NO_2$ over the soot-clogged filter under certain engine conditions will cause the particulates to be broken down and the filter to be cleaned. It is also known to provide a burner system, generally fuelled by diesel fuel which, when the filter becomes clogged, heats the filter substrate to burn off the particulates. Whilst the first system is a "passive" regeneration system which relies upon a catalytic action under certain engine conditions, the latter described system is an "active" system which can regenerate the filter regardless of engine operating conditions.

Another emission that is regulated by emission controls is NOx and one method of reducing NOx production is to provide an exhaust gas recirculation system in which a proportion of the exhaust gas flowing out of the engine is returned to the air intake. This has two effects. Firstly, the exhaust gas contains a high proportion of carbon dioxide and carbon monoxide which, for the purposes of combustion in the combustion chamber are inert gases. By displacing the oxygen inducted into the combustion chamber and replacing it with carbon dioxide and carbon monoxide, the rate of NOx formation is reduced. Also, a proportion of the heat energy created by the combustion is absorbed by the carbon dioxide in the exhaust stream due to the fact that carbon dioxide has a substantial heat absorption capacity and also due to the dissociation of carbon dioxide during combustion which also absorbs energy from the combustion process. Because of that energy absorption, the combustion pressure and temperature is reduced which also reduces the production of NOx. As stated above, catalytic regeneration systems for diesel particulate filters rely on the NOx emitted from the diesel engine to regenerate the filter and to prevent the filter from becoming clogged with particulates. Accordingly, the exhaust engine is faced with a conflict between reducing the level of NOx by exhaust gas recirculation which results in less NOx being available for regeneration of the filter which, in turn, results in the filter becoming clogged or allowing more NOx to be generated by the engine in order to regenerate the filter, with the deleterious effect of addition NOx production.

It is an object of the present invention to provide an improved internal combustion engine exhaust system.

SUMMARY OF THE DISCLOSURE

According to one aspect of the invention there is provided an internal combustion engine exhaust system having an exhaust gas recirculation path, a particulate filter and a burner to effect regeneration of the particulate filter.

In that way, by applying the burner regeneration method, NOx is no longer required to regenerate the filter which means that a greater level of exhaust gas recirculation can be effected in order better to reduce the NOx produced by the engine. The present invention provides a system which allows for regeneration of the particular filter across all engine operating systems with no restriction on the level of NOx reduction available by the exhaust gas recirculation system.

In a preferred embodiment the internal combustion engine exhaust system includes a trigger mechanism arranged to trigger regeneration of the filter by activation of the burner. The trigger mechanism preferably senses the back pressure in the exhaust system. As the filter becomes clogged, the back pressure will increase and when the back pressure exceeds a predetermined limit, the trigger mechanism fires the burner to effect regeneration of the particulate filter. Alternatively, the trigger mechanism could be a timer that ignites the burner after a predetermined period of engine operation. Other alternative trigger mechanisms are envisaged including a sensor for determining the mass of particulates retained by the filter or sensors which determine particular engine operating characteristics which might give rise to an increased level of particulates in the filter, for example urban driving. The trigger mechanism may include a combination of the aforementioned sensors.

The internal combustion engine exhaust system preferably includes a control means, for example an electronic control unit, which controls both the burner operation and the exhaust gas recirculation.

The exhaust gas recirculation path preferably takes exhaust gas from the point in the exhaust system downstream of the particulate filter. The exhaust gas recirculation path preferably includes a cooling mechanism arranged in the exhaust gas recirculation path. The exhaust gas circulation is preferably effected by the provision of exhaust gas recirculation valve in the air intake path of the engine. Opening of the valve allows exhaust gases to be drawn along the exhaust gas recirculation path by means of positive pressure from behind in the exhaust system and the negative pressure effected by the venturi effect of air passing along the air intake. Recirculated exhaust gas is thus combined with air intake gas.

The cooling mechanism arranged in the exhaust gas recirculation path may be arranged to provide addition cooling during operation of the burner. In that way, the increase in exhaust gas temperature of exhaust gases exiting the filter during operation of the burner is compensated by the extra cooling effected by the cooling mechanism so that exhaust gas recirculation is not compromised by the elevated temperatures. Alternatively, the control means may be arranged to shut down the exhaust gas recirculation valve to prevent exhaust gas recirculation during operation of the burner. That prevents hot gases being recirculated into the engine.

According to another aspect of the invention there is provided a method of operating an internal combustion engine exhaust system comprising the steps of providing a particulate filter, operating the particulate filter to filter particulates from the exhaust gas stream, recirculating exhaust gas into the engine air intake and periodically regenerating the particulate filter by means of a burner.

The step of periodically regenerating the particular filter preferably comprises effecting regeneration in response to a trigger, the trigger including one or more of the back pressure in the exhaust, the time elapsed since the last regeneration, other engine parameters indicative of particular engine operating conditions.

The step of recirculating the exhaust gas preferably includes cooling the recirculated exhaust gas. The method preferably includes the step of providing additional cooling to the recirculated exhaust gas on operation of the burner to regenerate the filter.

BRIEF DESCRIPTION OF THE DRAWINGS

An internal combustion engine exhaust system in accordance with the invention will now be described in detail by way of example and with reference to the accompanying drawings in which.

DETAILED DESCRIPTION

Figure 1:
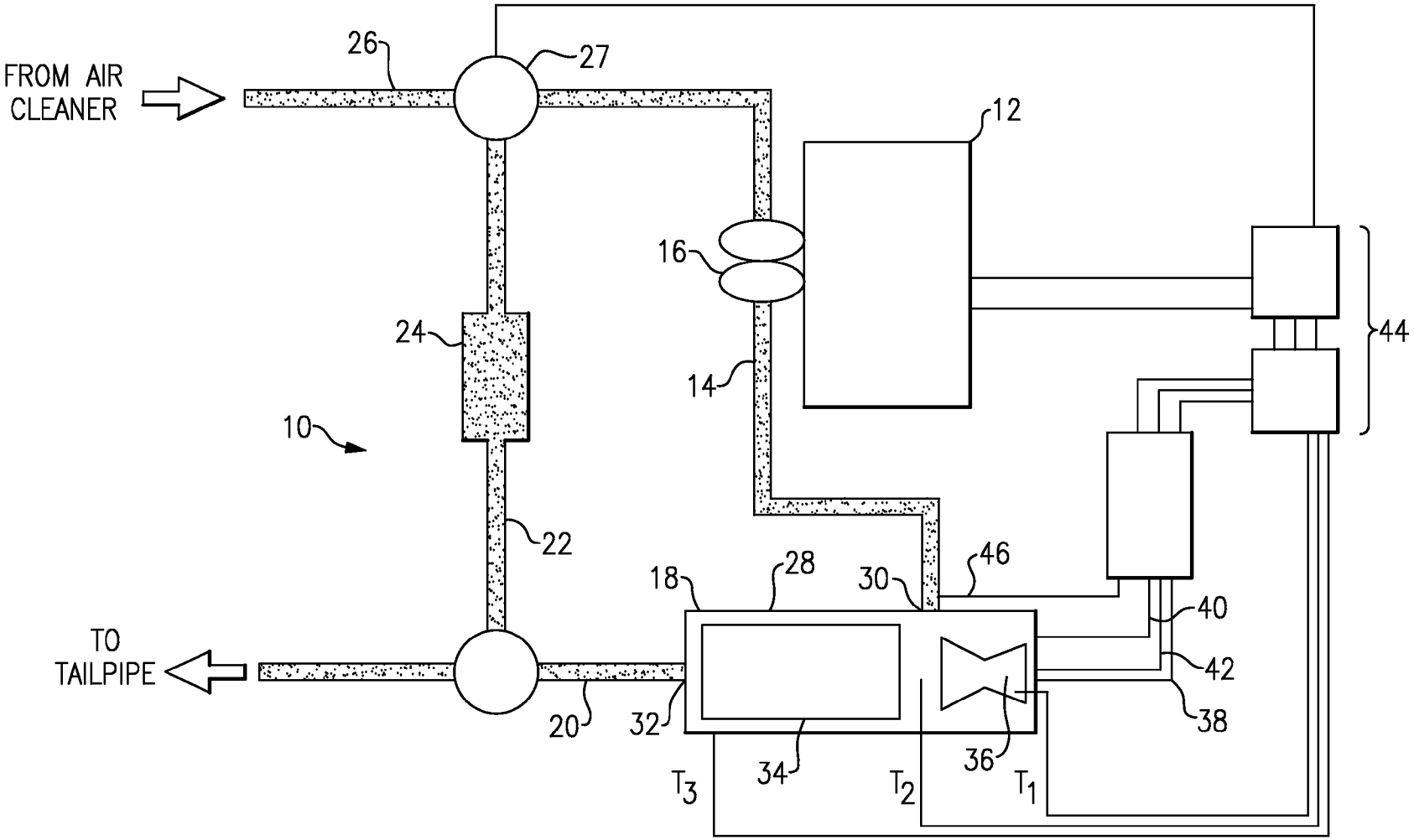
FIG. 1 is a schematic diagram of an internal combustion engine and exhaust system.

The exhaust system 10 comprises an exhaust manifold (not shown) which takes exhaust gas from the engine 12 and passes it to an exhaust pipe 14, via the exhaust side of a turbo charger 16. Downstream of the turbo charger 16, the pipe 14 passes into a particulate filter assembly 18. Downstream of the particulate filter 18, the exhaust gases pass into a second pipe 20. Part way along second pipe 20, there is an exhaust gas recirculation pipe 22 in fluid communication with the pipe 20. The pipe 20 extends beyond the junction with the exhaust gas recirculation pipe 22 to the remainder of the exhaust system, which is conventional and need not be described herein. The exhaust gas recirculation pipe 22 has a cooling mechanism 24 which allows gases passing along pipe 22 to be cooled. The end of the pipe 22 that is spaced from the exhaust pipe 20, has a junction with the air inlet pipe 26 of the diesel engine 12. The junction of the exhaust gas recirculation pipe 22 and the air inlet pipe 26 is controlled by a valve 27 which its open condition allows exhaust gases to flow from the pipe 20, from the pipe 22, through the cooler 24 and into the air pipe 26 and when closed prevents such flow.

The filter assembly 18 comprises a chamber 28 with exhaust inlet 30 and the exhaust outlet 32. The chamber 28 includes a filter element 34 arranged in such a way that exhaust gases entering the chamber 28 through the inlet 30 must pass through the filter 34 to reach the outlet 32. The chamber 18 also includes a burner arrangement 36.

The burner arrangement 36 receives fuel from a fuel storage, for example the fuel tank of a vehicle, via a fuel line 38. Combustion air is provided via an airline 40. An ignition device 42 is provided to effect ignition of the burner when necessary. An electronic control unit 44 or an array of electronic control units is provided to control the engine 12, the exhaust gas recirculation valve 27 and the burner assembly 36.

An exhaust gas back pressure sensor 46 senses the back pressure immediately upstream of the particulate filter 18 and passes that data to the ECU 44. Three temperature sensors T1, T2 and T3 pass sensed temperature data back to the ECU 44. T1 senses the burner temperature, T2 senses the temperature upstream of the filter and T3 senses the temperature downstream of the filter. The ECU 44 also receives data from the engine, for example engine speed and boost pressure are sensed and transmitted to the ECU.

In use, the engine 12 is operated in the normal way and exhaust gases leaving the engine 12 pass through the turbo charger 16 and into exhaust line 14. The exhaust gases which carry particulates are passed to particulate filter 18 where the particulates are filtered out from the exhaust gas stream. Downstream of the particulate filter 18, the exhaust gas passes into exhaust pipe 20 and then on to the remainder of the exhaust system. Where necessary, the ECU 44 controls the valve 27 at the junction of the air inlet pipe 26 and the exhaust gas recirculation pipe 22 to open. A combination of the positive pressure behind exhaust gas in the line 22 and negative pressure ahead from the venturi effect of the air passing through the air intake pipe 26, exhaust gases are drawn along pipe 22 through the cooling mechanism 24 and into the air inlet stream 26. In that way, air and exhaust gases are mixed together in the air inlet stream before passing through the inlet side of the turbo charger 16 into the combustion chambers of the engine. As described above, the presence of the exhaust gases in the air inlet stream reduces the proportion of oxygen in the combustion chamber which substantially reduces NOx. Also, NOx tends to be produced when the engine is running at high temperatures and the increased proportion of carbon dioxide in the inlet gas stream absorbs more energy from the combustion for a lower increase in temperature. Accordingly, the exhaust gas stream emerging from the combustion chambers of the engine 12 is at a lower temperature than would occur if operating in clean air.

Over time, the filter 34 becomes clogged with the filtered out particulates. As that occurs, the force required to push the exhaust gases through the filter 34 increases which increases the back pressure in the exhaust pipe 14 immediately upstream of the filter. If the back pressure exceeds a predetermined limit, the electronic control unit 44 initiates operation of burner 36. Fuel is supplied along the line 38 and air is supplied along the line 40. The fuel/air mixture is mixed in the burner head and the fuel/air mixture is ignited by means of the ignition device 42. When the burner ignites, the filter temperature is elevated which causes burning off of the clogging filter particles so as to clear the filter.

Accordingly, it is possible to operate the exhaust system 10 at high levels of exhaust gas recirculation to reduce the level of NOx output whilst avoiding the compromise requirement of particulate filters that require NOx regeneration of the filter itself.

Figure 2:
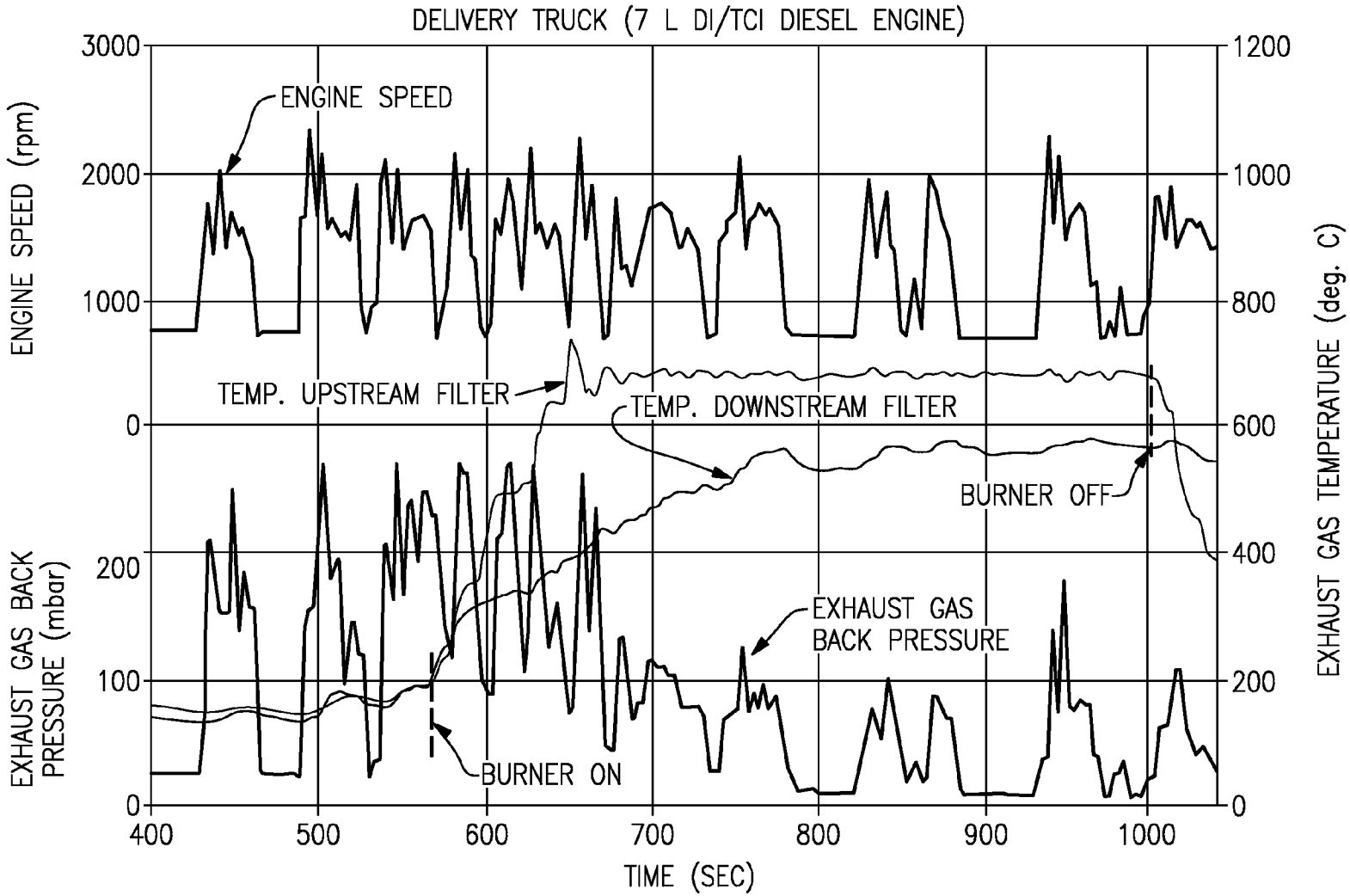
FIG. 2 is a graph showing the operation of an exhaust system having a burner supported particulate filter regeneration system 10 is coupled to an internal combustion engine 12, in this case a diesel engine.

FIG. 2 shows a graph illustrating the on-road operation of exhaust system with a particulate filter trap which is regenerated by means of a burner. It can be seen that any substantial increase in engine speed results in a substantial increase in exhaust gas-back pressure which is primarily due to the clogging of a filter by particulates. In the graph shown, the burner system was ignited after approximately 560 seconds and the temperature of the exhaust gas flow upstream of the filter increases from approximately 100° C. degrees to approximately 650° C. degrees in 50-60 seconds. That exhaust gas temperature is then maintained by operation of the burner until a measurable drop in exhaust gas back pressure is detected. As can be seen in the Figure, even shortly after the filter is heated by the burner, for example at 700 seconds, the exhaust gas back pressure has depleted substantially which indicates that the passage of gas through the filter is considerably more straight forward even after a short period of burner operation.

The invention claimed is:

1. An internal combustion engine exhaust system comprising a particulate filter through which substantially all engine exhaust gas from an internal combustion engine is directed, an exhaust gas recirculation path which recirculates engine exhaust gas from a point in the exhaust system downstream of the particulate filter into an engine air intake, and a fuel-fired burner to effect regeneration of the particulate filter while the particulate filter is filtering the engine exhaust gas.

2. An internal combustion engine exhaust system according to claim 1 in which there is provided a trigger mechanism arranged to trigger regeneration of the filter by activation of the burner.

3. An internal combustion engine exhaust system according to claim 2 in which the trigger mechanism senses the back pressure in the exhaust system.

4. An internal combustion engine system according to claim 2 in which the trigger mechanism is a timer that ignites the burner after a predetermined period of engine operation.

5. An internal combustion engine exhaust system according to claim 2 in which the trigger mechanism senses a combination of two or more of exhaust back pressure, time elapsed since last burn, mass of particulates retained by filter and particular engine operating characteristics.

6. An internal combustion engine exhaust system according to claim 1 in which the internal combustion engine exhaust system comprises a controller which controls both the burner operation and the exhaust gas recirculation.

7. An internal combustion engine exhaust system according to claim 1 in which the exhaust gas recirculation path includes a cooling mechanism arranged in the exhaust gas recirculation path.

8. An internal combustion engine exhaust system according to claim 1 in which the exhaust gas recirculation is effected by the provision of an exhaust gas recirculation valve in the air intake path of the engine.

9. An internal combustion engine exhaust system according to claim 7 in which the cooling mechanism arranged in the exhaust gas recirculation path is arranged to provide additional cooling during operation of the burner.

10. An internal combustion engine exhaust system according to claim 8 in which the exhaust gas recirculation valve is closed to prevent exhaust gas recirculation during operation of the burner.

11. A method of operating an internal combustion engine exhaust system comprising the steps of directing substantially all exhaust gas from an internal combustion engine through a particulate filter, operating the particulate filter to filter particulates from the exhaust gas, recirculating the exhaust gas from a point in the exhaust system downstream of the particulate filter into an engine air intake, and periodically regenerating the particulate filter with a fuel-fired burner while the particulate filter is filtering the engine exhaust gas.

12. A method of operating an internal combustion engine exhaust system according to claim 11 in which the step of periodically regenerating the particulate filter comprises effecting regeneration in response to a trigger, the trigger including one or more of the back pressure in the exhaust, the time elapsed since the last regeneration, other engine parameters indicative of particular engine operating conditions.

13. A method of operating an internal combustion engine exhaust system according to claim 11 in which the step of recirculating the exhaust gas includes cooling the recirculated exhaust gas.

14. A method of operating an internal combustion engine exhaust system according to claim 13 in which the method includes the step of providing additional cooling to the recirculated exhaust gas on operation of the burner to regenerate the filter.

15. An internal combustion engine exhaust system according to claim 7 in which the exhaust gas recirculation is effected by the provision of an exhaust gas recirculation valve in the air intake path of the engine.

16. An internal combustion engine exhaust system having an exhaust gas recirculation path which recirculates engine exhaust gas from a point in the exhaust system downstream of the particulate filter into the engine air intake, a cooling mechanism arranged in the exhaust gas recirculation path, a particulate filter and a fuel-fired burner to effect regeneration of the particulate filter.

17. An internal combustion engine exhaust system according to claim 16 in which the cooling mechanism arranged in the exhaust gas recirculation path is arranged to provide additional cooling during operation of the burner.

18. A method of operating an internal combustion engine exhaust system comprising the steps of providing a particulate filter, operating the particulate filter to filter particulates from the exhaust gas stream, providing a cooling mechanism arranged in an exhaust gas recirculation path, recirculating exhaust gas from a point in the exhaust system downstream of the particulate filter along the exhaust gas recirculation path into the engine air intake and periodically regenerating the particulate filter with a fuel-fired burner.

19. The method of claim 18 in which the exhaust gas recirculation is effected by the provision of an exhaust gas recirculation valve in the air intake path of the engine.

20. An internal combustion engine exhaust system comprising a particulate filter through which substantially all exhaust gas from an internal combustion engine is directed, an exhaust gas recirculation path which recirculates engine exhaust from a point in the exhaust system downstream of the particulate filter into an engine air intake, and a fuel-fired burner to effect regeneration of the particulate filter.

21. The internal combustion engine exhaust system of claim 1 further comprising a cooling mechanism arranged in the exhaust gas recirculation path.

22. The internal combustion engine exhaust system of claim 1 further comprising a cooling mechanism arranged in the exhaust gas recirculation path.

23. The internal combustion engine exhaust system of claim 20 further comprising a cooling mechanism in the exhaust gas recirculation path.

24. The internal combustion engine exhaust system of claim 1 further comprising a turbo charger turbine.

25. The internal combustion engine exhaust system of claim 16 further comprising a turbo charger engine.

26. The internal combustion engine exhaust system of claim 20 further comprising a turbo charger engine.

27. The internal combustion engine exhaust system of claim 21 further comprising a turbo charger engine.

28. The internal combustion engine exhaust system of claim 16, wherein the particulate filter includes a filter housing having a single exhaust inlet, a single exhaust outlet, and a filter positioned within the filter housing such that all exhaust gases from an engine enters the exhaust inlet, goes through the filter, and exits the exhaust outlet, and wherein the burner effects regeneration of the particulate filter while the particulate filter is filtering the engine exhaust gas.

29. The internal combustion engine exhaust system of claim 20, wherein the burner effects regeneration of the particulate filter while the particulate filter is filtering the engine exhaust gas.

30. The internal combustion engine exhaust system of claim 16 wherein substantially all of the engine exhaust gas is directed through the particulate filter.

31. The method of claim 18 further comprising the steps of directing substantially all the exhaust gas through the particulate filter by providing the particulate filter with a filter housing having a single exhaust inlet, a single exhaust outlet, and a filter positioned within the filter housing such that all exhaust gases from an internal combustion engine enters the exhaust inlet, goes through the filter, and exits the exhaust outlet, and including positioning a burner of the fuel-fired burner in the filter housing upstream of the filter with the single exhaust inlet being positioned axially between the burner and the filter such that the burner effects regeneration of the particulate filter while the particulate filter is filtering the engine exhaust gas.

32. The internal combustion engine exhaust system according to claim 1 including a sensor immediately upstream of the particulate filter to measure back pressure of the particulate filter, and wherein operation of the fuel-fired burner is initiated when the back pressure exceeds a predetermined limit.

33. The internal combustion engine exhaust system according to claim 1 including a fuel line that directly supplies fuel to the fuel-fired burner, an air line that supplies air directly to the fuel-fired burner to mix with the fuel to provide combustion air, and an ignition device that ignites the combustion air to ignite the fuel-fired burner.

34. The internal combustion engine exhaust system of claim 20 including a sensor immediately upstream of the particulate filter to measure back pressure of the particulate filter, and wherein operation of the fuel-fired burner is initiated when the back pressure exceeds a predetermined limit.

35. The internal combustion engine exhaust system of claim 20 including a fuel line that directly supplies fuel to the fuel-fired burner, an air line that supplies air directly to the fuel-fired burner to mix with the fuel to provide combustion air, and an ignition device that ignites the combustion air to ignite the fuel-fired burner.

36. The internal combustion engine exhaust system according to claim 33 wherein the particulate filter comprises a filter housing having a single exhaust inlet, a single exhaust outlet, and a filter positioned within the filter housing such that all exhaust gases from an engine enters the exhaust inlet, goes through the filter, and exits the exhaust outlet, and wherein the fuel-fired burner includes a burner positioned within the filter housing upstream of the filter.

37. The internal combustion engine exhaust system according to claim 36 wherein the single exhaust inlet is positioned axially between the burner and the filter.

38. A method of operating an internal combustion engine exhaust system according to claim 11 including providing the particulate filter with a filter housing having a single exhaust inlet, a single exhaust outlet, and a filter positioned within the filter housing such that all exhaust gases from an internal combustion engine enters the exhaust inlet, goes through the filter, and exits the exhaust outlet, and including positioning a burner of the fuel-fired burner in the filter housing upstream of the filter with the single exhaust inlet being positioned axially between the burner and the filter.

39. The internal combustion engine exhaust system of claim 20 wherein the particulate filter includes a filter housing having a single exhaust inlet, a single exhaust outlet, and a filter positioned within the filter housing such that all exhaust gases from the internal combustion engine enters the exhaust inlet, goes through the filter, and exits the exhaust outlet, and wherein the fuel-fired burner includes a burner positioned within the filter housing upstream of the filter with the single exhaust inlet being positioned axially between the burner and the filter such that the burner effects regeneration of the particulate filter while the particulate filter is filtering the engine exhaust gas.

* * * * *